United States Patent [19]

May

[11] 4,419,655

[45] Dec. 6, 1983

[54] GOLF COURSE PLAY INDICATOR DEVICES

[75] Inventor: Brian E. May, Amsterdam, N.Y.

[73] Assignee: Precision Golf Design, Inc., Ballston Spa, N.Y.

[21] Appl. No.: 173,951

[22] Filed: Jul. 30, 1980

[51] Int. Cl.[3] ..... G08B 23/00; A63B 67/02

[52] U.S. Cl. ..... 340/323 R; 340/286 M; 434/252; 434/430; 273/32 R; 273/176 L; 40/442; 40/569

[58] Field of Search ..... 340/323 R, 286 M, 525, 340/515, 286 R; 434/252, 430; 273/32 R, 32 H, 34 R, 176 L, 177 R, 32 A, 178 R, 178 B; 40/442, 452, 569, 463

[56] References Cited

U.S. PATENT DOCUMENTS

| | | | |
|---|---|---|---|
| 3,478,452 | 11/1969 | Bidwell et al. | 273/32 H |
| 3,573,792 | 4/1971 | Reed | 340/286 M |
| 3,685,168 | 8/1972 | Reitz | 434/252 |
| 4,245,216 | 1/1981 | Rintoul | 340/323 R |

*Primary Examiner*—Donnie L. Crosland
*Attorney, Agent, or Firm*—Carroll F. Palmer

[57] ABSTRACT

An indicator device to inform golfers of the position of the cup on the green and other play aspects of a hole of a golf course. It has a display panel carrying a graphic representation of the hole including the tee and green, a grid of electrically energizable indicators associated with the green representation, an array of electrically energizable indicators associated with the tee representation and electrical circuitry for energizing predetermined indicators in the grid and the array.

14 Claims, 4 Drawing Figures

FIG. 1
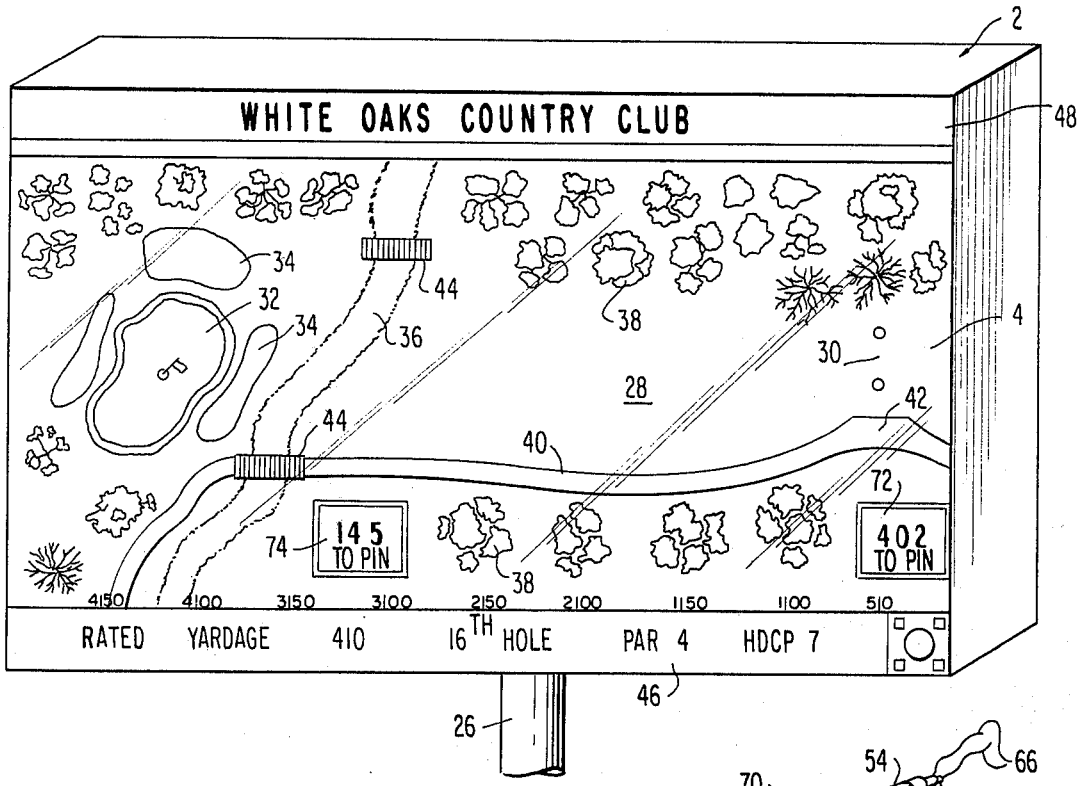
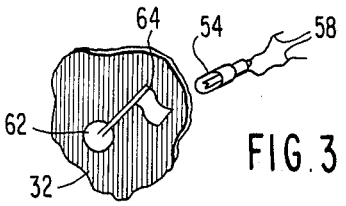
FIG. 3
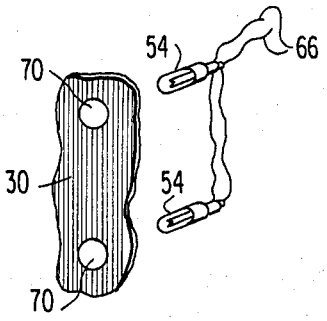
FIG. 4
FIG. 2
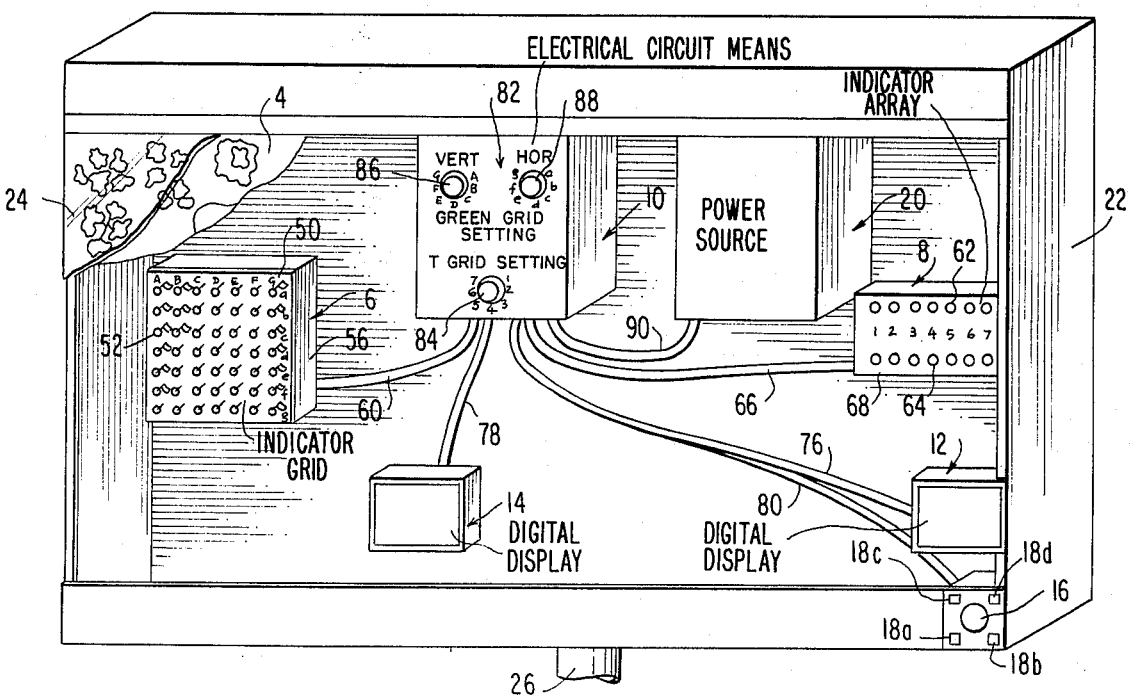

GOLF COURSE PLAY INDICATOR DEVICES

BACKGROUND OF THE INVENTION

1. Field of the Invention

The invention broadly relates to equipment to improve the play of golf on a golf course. More particularly, it concerns indicator device by which golfers before playing the hole of a golf course will know the tee marker location, pin placement on the green, pertinent distances and other play aspects for that particular golf hole.

2. Description of the Prior Art

Proper administration and management of a well operated golf course involves the periodic movement of the cup to various positions around the green to prevent the excessive wear that would occur if the cup constantly remained in one spot. Tee-off positions are also varied from time to time to prevent excessive wear on the tee and vary play with change in course conditions.

Changes in cup and tee-off positions can significantly affect the manner in which golfers will play a given hole on a given day. Players seek to visualize the hole as to its length, the placement of the cup (pin) on the green, its relationship to traps and other hazards. To assist players in such playing activities, some golf clubs provide in their club houses pictorial representations of their course with the various greens, using markers to roughly indicate location of the cup on the green. Of course, unless the player marks such information on a card or the like, he is not likely to remember such details during much of his play of the course. Player uncertainty about cup position and similar information often leads to delays in play and a resulting decrease in the day's capacity of the course.

Various innovations have been made to provide golfers with course information to assist in their play of the course. This has included unique course maps or card representations of course layout (see U.S. Pat. Nos. 3,552,290 and 3,805,411). Another innovation involves providing at each tee location a relief model of the green for that hole, having a marker that can be moved about to indicate position of the cup on the green (see U.S. 3,685,168). Such a device, however, fails to provide the player with tee to cup distance for the day, visualization of the green relative to the remainder of the hole, etc.

There exists a need for improved ways for golf course managers to better provide play information desired by the players in an efficient and player acceptable manner. This would not only serve to enhance the enjoyment of play by the golfers, but play will be speeded up and course administration improved.

OBJECTS

A principal object of this invention is the provision of new equipment to help improve the play of golf on a golf course.

Further objects include the provision of:

(1) Unique indicator devices by which golfers before they play any given hole on a course will know the tee marker locations, pin placement on the green, pertinent distances and other play aspects for that particular golf hole.

(2) New golf course equipment that will help players to make quicker club selection through more explicit hole understanding, thereby aiding in the speedup of play on the course.

(3) Such equipment designed to lighten the workload of the golf course superintendent.

(4) New methods for informing golfers about pin placement on the green and related knowledge about each hole as it is played by the golfer.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished in accordance with the present invention by the construction of golf course play indicator devices that comprise in combination a display panel that carries a graphic representation of the layout of a hole of a golf course including the tee and the green, a grid of a multiplicity of electrically energizable indicators associated with the representation of the green, an array of a multiplicity of electrically energizable indicators associated with the representation of the tee and electrical circuit means for energizing predetermined indicators in the grid and array.

In a preferred form of the new indicator devices the panel is opaque and the grid for the green is formed of vertical and horizontal rows of small transparent circles, squares or the like behind which are positioned small light bulbs, light emitting diodes (LEDs), or similar illuminators. In another preferred form, the green is a transparent portion in the display panel revealing a green colored grid of liquid cystal display elements (LCDs). The position of the cup on the green is indicated to a golfer by energizing the indicator in the grid that corresponds to the cup position for that particular day of play.

Also in some preferred forms, the array for the tee is formed of two spaced apart rows of transparent circles, squares, etc., in the panel behind which are positioned small illuminators. The location of the tee-off position for the day is indicated by lighting one illuminator in each row. Alternatively, the tee may be an array of LCDs.

The selection of the indicators in the grid and array is accomplished by switch means in the electrical circuit means of the indicator device. Such circuit means also automatically serves to energize changeable display elements, e.g., electronic digital units such as LEDs, LCDs or related types of numerical displays, contained in the new indicator devices to show various distances, e.g., tee to cup, for the particular hole on the day of play.

The new devices also comprise weatherproof enclosures, power sources, transparent cover plates and other features that are discussed in further detail below.

BRIEF DESCRIPTION OF THE DRAWINGS

A more complete understanding of the invention may be had by reference to the accompanying drawing in which:

FIG. 1 is a perspective lateral view of a new golf course play indicator device of the invention.

FIG. 2 is a view similar to FIG. 1 with the graphic display panel of the device partially broken away to show internal elements.

FIG. 3 is a fragmentary view of a single illuminator unit of the green grid unit of the new device.

FIG. 4 is a fragmentary view of a pair of illuminators of the tee array unit of the new device.

DESCRIPTION OF THE PREFERRED EMBODIMENTS

Referring in detail to the drawings, the indicator device 2 basically comprises a display panel 4, a grid 6, an array 8 and electrical circuit means 10. It also advantageously includes changeable display elements 12 and 14, time delay switch 16, electrical circuit lock means 18*a*, 18*b*, 18*c* and 18*d*, power source 20, weatherproof case 22, transparent cover plate 24 and standard 26.

The display panel 4 may be formed of any suitable sheet material although it is preferred to make the panel of transparent plastic and form the graphic presentation 28 thereon of opaque coating material, e.g., lacquer, by silk-screening or the like. The graphic presentation 28 will include a representation of the tee 30, green 32, sandtraps 34, water hazards such as creek 36 and trees 38, golf cart path 40, cart parking area 42 and bridges 44. Each panel will be individually formed to give an accurate picture of the entire hole from tee to green and surroundings. An aerial photograph or scale drawing of the golf hole may be used to create the graphic display 28 for the panel 4. The base strip 46, which can be a front portion of the weatherproof case 22, in the device as illustrated shows that the course hole is No. 16 with a rated yardage of 410, a par of 4 and a handicap of 7.

The panel 4 is advantageously held in position on the case 22 by the base strip 46 and the upper strip 48. These strips also serve to hold the transparent cover 24 over the face of the panel 4. The cover 24 may be made of transparent plastic, tempered glass or other sheet material. It serves to protect the panel 4 from vandals and the weather. It may be tinted or otherwise treated to provide u.v. filtration to mitigate deterioration of the display panel 4.

The grid 6 comprises vertical rows 50 and horizontal rows 52 of energizable indicators 54 held in the circuit box 56. The indicators 54 may be electrical illuminators such as small light bulbs, LEDs or the like, or display elements such as LCDs, each electrically connected by lead wires 58 to circuit means 10. The numerous wires 58 from the box 56 form a cable 60 between box 56 and circuit means 10.

In an alternative form of the new devices, the grid 6 may be a green colored area containing vertical and horizontal rows of LCDs which is displayed through a transparent section outlining the golf green in the panel 4.

As seen in FIG. 3, each illuminator 54 is positioned behind a transparent portion 62 in the opaque representation 32 of the green. The portion 62 may be a simple circle, square or the like, but advantageously it may be shaped to appear as a green pin 64. When one of the illuminators 54 is energized it will indicate to a viewer the position of the cup on the green for the hole on the day of play.

The grid 6 when formed of vertical and horizontal rows of illuminators or the like as explained above lends itself to standardized manufacture of the new indicator devices. Thus, a single design for a grid can be used for all the devices regardless of the outline of the green 32. However, it is possible to form each grid separately in a shape corresponding to the outline of the green. Also, instead of having the illuminators behind the panel 4 to show through transparent portions 62, small light bulbs 54 could extend through holes (not shown) in the panel 4.

The array 8 for the tee 30 comprises a pair of spaced apart rows 62 and 64 of energizable indicators 54 (see FIG. 4) equipped with lead wires 66. The combined multiplicity of wires 66 from all the tee indicators 54 form a cable 66 between the circuit box 68 and the circuit means 10. The tee indicators 54 are positioned behind transparent circles or other shaped portions 70 in the tee area 30 of the graphic presentation 28. The tee indicators 54 are energized in pairs to show players the tee-off line on the tee for the day of play.

As explained with regard to grid 6, the array 8 may be formed in a variety of ways other than as illustrated in the drawings.

The changeable display elements 12 and 14 are positioned behind transparent portions (windows) 72 and 74 respectively so that a player may view the display element when it is energized. The indicia "To Pin" (or other wording if used) may be printed on the panel 4 within the area of the windows 72 and 74 or, alternatively, such indicia may be part of the display elements 12 and 14. These elements when energized give the golfer pertinent distance information, e.g., distance from tee to cup, actual distance from the 150 yard radius to the cup or the like. Display elements 12 and 14 are electrically connected to circuit means 10 by cables 76 and 78 respectively. The display elements 12 and 14 may be formed according to well-known technology from liquid crystal elements, LEDs or similar units now extensively available for digital display.

The time delay switch 16 and the circuit locks 18*a–d* are electrically connected to the circuit means 10 via cable 80. When a golfer depresses the switch 16, the device will be put in "on mode" for a predetermined time, e.g., 20 seconds, to enable the golfer to obtain the desired information. The device then returns to the "off mode" so that energy in the power source 20 is preserved. Where the indicators 50, 52, 62 and 64 are LCDs, the power may remain on continually so that, in such an embodiment, switch 16 is not required.

The locks 18*a–d* enable the course manager or other authorized person supplied with necessary keys to reset the different display elements for changed conditions. For example, lock 18*a* electrically interconnects with circuit means 10 to allow reset of the 150 marker to pin display 14. Lock 18*b* will allow, as an example, reset of the tee to cup distance display 12; lock 18*c* would allow reset of the grid 6 and lock 18*d* reset the array 8. Reset lock keys can all be different or the same. Of course, locks 18*a–d* need not be included in the new devices if security is not a concern. Also, units equivalent to the locks may be located within case 22 which can be locked in any suitable manner (not shown) for security purposes. The switch 16 may be a push-button type, a capacitor induction type or any other commercially available switch unit, preferably of an adjustable time delay type.

The electrical circuit means 10 comprises a first switch means 82 to allow selection of one of the illuminators 54 in the grid 6 to be energized when the device 2 is put in the "on mode" and a second switch means 84 to allow selection of one of the pairs of illuminators 54 in array 8 to be also energized during the "on mode".

The first switch means 82 may have a first selector 86 designating positions in vertical rows 50 of grid 6 and second selector 88 designating positions in horizontal rows 52 of grid 6. Rotary switches are shown in FIG. 2, but equivalent units, e.g., pushbutton arrays, available in the electrical and electronic markers may be used.

The internal structure of circuit means 10 is not shown because this can take a variety of forms. Minicomputer and microprocessor components and circuits are a highly developed art and those skilled in such art can readily supply suitable circuit means to automatically energize items 6, 8, 12 and 14 in the manner described above when the reset data has been inserted into the circuit means 10. Such circuits will be designed so that setting of the cup and tee positions by use of switch means 82 and 84 will produce automatic resetting of the digital readouts for display units 12 and 14. In place of digital electronic circuits for the means 10, analog circuit devices may be used without requiring power sources other than source 20.

The power source 20 is connected to the circuit means 10 by cable 90. Preferably source 20 will be a battery pack of the rechargeable type. Alternatively, a photovoltaic package may be used as the power supply 20. If the tee for the hole is close to an AC main, power may be obtained by use of a transformer/rectifier package. Battery life can exceed one year of use since the system will draw minimal power when LCDs are used or where illuminators such as LEDs are used with a delay switch as described.

The standard or mounting post 26 may be designed to accept a ball washer, spike cleaning device, trash receptacle and/or other like devices.

CONCLUSION

The indicator devices of the invention provide a simple, reliable, effective and attractive system for indicating golf hole layouts at each tee position of each hole of the course. The devices may be utilized as an indicating reference system tailored to each individual golf hole. Various sections or parts of the new devices may be made modular so that initial manufacture and subsequent maintenance will be facilitated.

The new devices will display a color layout of a hole, to scale, at each tee box and can include a display of such data as tee marker location, cup placement on the green, pertinent distances, tee to green hole layout, hole number, handicap, par, rated yardage, etc. The player will see at the tee a complete graphic color layout of the hole including hazards, cart paths, rough, etc. Where multicolored tee markers, e.g., red, white and blue, are utilized, this can be indicated. The panel 4 may have depth effects added where desired to give three-dimensional effect for greater accuracy.

The new devices will be easy for the course manager or other authorized personnel to use. A chart with numeric cross-references can be supplied by a manufacturer for each device which will be used in making tee and green position changes. When a cup or tee change is required, simple changes to the switch means 82 and 84 will reset all displays automatically to correspond to the new settings.

The new devices will help to speed up play on the course and assist the player in making quicker club selection for the hole. Also, course maintenance can be improved by referring to the indicator panels on the job for planning mowing patterns, hole changes, and other maintenance applications. The green grid and tee array also provide the pro and/or superintendent a matrix with which to plot the optimum traffic patterns on greens and tees by utilizing systematic placement. In addition, the club has the option of controlling each display individually for tournament play if elimination of an individual display is required.

The embodiments of the invention in which an exclusive property or privilege is claimed are defined as follows:

1. A golf course play indicator device comprising:

a display panel which carries a graphic representation of the layout of a hole of a golf course including the tee and the green comprising a cup, a grid of a multiplicity of electrically energizable indicators arranged in vertical and horizontal rows within said representation of said green, an array of a multiplicity of electrically energizable indicators arranged in two spaced apart rows within said representation of said tee, an electrically energizable and changeable digital display unit to indicate the distance from the tee to said cup on said green, electrical circuit means comprising first switch means to selectively energize one of said indicators of said grid to indicate said cup position on said green and second switch means to energize one indicator in each of said two rows in said array to indicate a tee-off line on said tee, and means to automatically change said digital display of distance in response to changes made to said first and second switch means.

2. The indicator device of claim 1 wherein said first switch means has a first selector designating positions in vertical rows of said grid and a second selector designating positions in horizontal rows of said grid.

3. The indicator device of claim 1 that comprises in addition a second electrically energizable and changeable digital display unit to indicate the distance from said cup on said green to a pre-selected radius distance marker on said course layout and means to automatically change said second digital display of distance in response to changes made to said first and second switch means.

4. The indicator device of claim 3 wherein said distance marker is a 150 yard marker.

5. The indicator device of claim 1 having a time delay switch accessible to golfers playing said hole of said golf course to activate said electrical circuit means for a predetermined time interval and then automatically deactivate said circuit means.

6. The indicator device of claim 1 having lock means that prevents unauthorized adjustment of said first and second switch means.

7. The indicator device of claim 1 that includes a battery pack to supply electrical energy to said electrical circuit means.

8. The indicator device of claim 1 that includes a photovoltaic unit to supply electrical energy to said electrical circuit means.

9. The indicator device of claim 1 that is contained in a weatherproof case carried upon a locking post mount and there is a transparent plate covering said display panel.

10. The indicator device of claim 1 wherein said grid indicators and array indicators are illuminators positioned behind said panel and viewable through transparent portions of the panel when energized.

11. The indicator device of claim 1 wherein said grid indicators and array indicators are liquid crystal display elements that are visible as a part of the respective green representation and tee representation to a viewer of said device only when said indicators are energized.

12. The golf course play indicator device of claim 1 wherein said energizable indicators are liquid crystal displays and said device includes a liquid crystal display element to indicate the distance from tee to cup of the hole displayed on said device and another liquid crystal display element to indicate the actual 150 yard marker to pin distance dependent upon the pin placement on said tee.

13. A method of informing golfers of vital play aspects of a hole of a golf course substantially immediately prior to the golfer's beginning of play of said hole which comprises:

providing adjacent the tee of said hole a display panel which carries a graphic representation of the layout of said hole of the golf course including the tee and the green, providing in the green portion of said display panel a plurality of first electrically energizable indicators spaced apart that serve upon being energized to show the position of the cup upon said green at the time of said play, energizing one of said first indicators to show said cup position, providing in the tee portion of said display panel a plurality of second electrically energizable indicators spaced apart that serve upon being energized to show a tee-off position on said tee at the line of play, energizing a pair of said indicators to show said tee-off position, providing on the panel an electrically energizable and changeable digital display unit to indicate the distance from the tee to said cup on said green, and automatically controlling said digital display of distance by changes in said energizing of said first and second indicators.

14. The method of claim 13 that further comprises:

providing on said panel a second electrically energizable and changeable digital display unit to indicate the distance from the cup on said green to a preselected radius distance marker on said course layout and automatically controlling said second digital display of distance by changes in said energizing of said first and second indicators.

* * * * *